US011260491B2

(12) United States Patent
Maruyama et al.

(10) Patent No.: US 11,260,491 B2
(45) Date of Patent: Mar. 1, 2022

(54) METHOD FOR GRINDING TIP OF ROTOR BLADE, AND JIG FOR GRINDING UP OF BLISK

(71) Applicant: IHI Corporation, Koto-ku (JP)

(72) Inventors: Koji Maruyama, Tokyo (JP); Yu Eto, Tokyo (JP); Yasutaka Kishimoto, Tokyo (JP)

(73) Assignee: IHI Corporation, Koto-ku (JP)

( * ) Notice: Subject to any disclaimer, the term of this patent is extended or adjusted under 35 U.S.C. 154(b) by 597 days.

(21) Appl. No.: 16/051,621

(22) Filed: Aug. 1, 2018

(65) Prior Publication Data

US 2018/0339390 A1 Nov. 29, 2018

Related U.S. Application Data

(63) Continuation of application No. PCT/JP2017/003336, filed on Jan. 31, 2017.

(30) Foreign Application Priority Data

Feb. 9, 2016 (JP) ..... JP2016-022371

(51) Int. Cl.

| | |
|---|---|
| ***B24B 19/14*** | (2006.01) |
| ***B24B 41/06*** | (2012.01) |
| ***F01D 5/00*** | (2006.01) |
| ***B24B 41/00*** | (2006.01) |

(52) U.S. Cl.

CPC ..... *B24B 19/14* (2013.01); *B24B 41/007* (2013.01); *B24B 41/06* (2013.01); *B24B 41/067* (2013.01); *F01D 5/005* (2013.01)

(58) Field of Classification Search

CPC ..... B24B 19/14; B24B 41/007; B24B 41/06; B24B 41/067; F01D 5/005; F01D 25/285

See application file for complete search history.

(56) References Cited

U.S. PATENT DOCUMENTS

| | | | | |
|---|---|---|---|---|
| 4,961,686 | A | 10/1990 | Blair et al. | |
| 2005/0102835 | A1 | 5/2005 | Trewiler et al. | |
| 2009/0113683 | A1 * | 5/2009 | Secherling | B24B 19/14 29/23.51 |

(Continued)

FOREIGN PATENT DOCUMENTS

| | | | |
|---|---|---|---|
| DE | 34 02 066 A1 | 8/1985 | |
| DE | 3402066 A1 * | 8/1985 | B25B 5/065 |

(Continued)

OTHER PUBLICATIONS

Japanese Office Action dated May 8, 2019 in Patent Application No. 2017-566592, 2 pages.

(Continued)

*Primary Examiner* — Joel D Crandall

(74) *Attorney, Agent, or Firm* — Oblon, McClelland, Maier & Neustadt, L.L.P.

(57) ABSTRACT

When a tip of a blade cascade is ground with a grindstone, a jig is inserted between blade cascades of a blisk and a jig is inserted between blade cascades. A blade locking section of the jig locks with a side section in the width direction of a corresponding rotor blade via a damping member made from rubber or the like. A disk locking section of the jig locks with a disk of the blade cascade which the blade locking section locks with.

7 Claims, 3 Drawing Sheets

(56) References Cited

U.S. PATENT DOCUMENTS

| | | | |
|---|---|---|---|
| 2011/0023300 | A1 | 2/2011 | Berlanger et al. |
| 2011/0256809 | A1 | 10/2011 | Baudimont et al. |

FOREIGN PATENT DOCUMENTS

| | | | |
|---|---|---|---|
| DE | 197 11 337 | A1 | 9/1998 |
| DE | 10 2008 062 364 | A1 | 6/2010 |
| JP | 61-297074 | | 12/1986 |
| JP | 02-245402 | | 10/1990 |
| JP | 2005-201242 | | 7/2005 |
| JP | 2009-039746 | | 2/2009 |
| JP | 2011-517627 | A | 6/2011 |
| JP | 2012-500730 | | 1/2012 |

OTHER PUBLICATIONS

International Search Report dated Apr. 11, 2017 in PCT/JP2017/003336 filed Jan. 31, 2017 (with English Translation).
Written Opinion dated Apr. 11, 2017 in PCT/JP2017/003336 filed Jan. 31, 2017.
Extended European Search Report dated Oct. 23, 2019 in Patent Application No. 17750126.9, 8 pages.

* cited by examiner

METHOD FOR GRINDING TIP OF ROTOR BLADE, AND JIG FOR GRINDING UP OF BLISK

CROSS REFERENCE TO RELATED APPLICATIONS

This application is a continuation application of International Application No. PCT/JP2017/003336, filed on Jan. 31, 2017, which claims priority to Japanese Patent Application No. 2016-022371, filed on Feb. 9, 2016, the entire contents of which are incorporated by reference herein.

BACKGROUND

1. Technical Field

This disclosure relates to a method for grinding (polishing) a tip of a rotor blade in a blisk (integrally bladed disk, integrated bladed rotor) of axial-flow turbomachinery, such as a compressor or a turbine, and to a jig used therefor.

2. Description of the Related Art

In a conventional rotor in the axial-flow turbomachinery, such as a compressor or a turbine, a dovetail of a detachable rotor blade is fitted into a slot formed in the circumferential surface of a disk. The advantage of such a blade wheel consists in the capability to replace only a damaged rotor blade. Hereinafter, a blade wheel having a detachable rotor blade fitted into a disk will be referred to as a blade-disk assembled wheel, for convenience of description.

A blisk is a blade wheel formed from a disk and rotor blade both integrally provided. Use of the blisk has recently started for the purpose of improving the mechanical strength and lightweight properties. The examples of specific advantages of the blisk are, a reduction of the number of components used for coupling a disk with a rotor blade, a reduction of the air resistance in a coupling section between a disk and a rotor blade, an improvement in compression efficiency of a combustion gas associated with the reduction of the air resistance, and the like.

Then, a blade-disk assembled wheel may be combined with a blisk to form a rotor, taking the advantage of each of two types of blade wheels described above.

Incidentally, in a rotor, it is important to precisely finish the blade length of a rotor blade in order to maintain the airtightness of a combustion gas between rotor blades. Then, a work to grind the tip of a rotor blade is performed while rotating the rotor blade in manufacturing a rotor. Grinding of a rotor blade is disclosed in Japanese Translation of PCT International Application Publication No. JP-T-2012-500730.

SUMMARY

In grinding a tip of a rotor blade in a blade-disk assembled wheel, this blade-disk assembled wheel rotates rapidly. This is because a sufficient centrifugal force needs to be given to a blade so that the position of the tip reaches a position similar to the position during actual operation of a compressor or a turbine. On the other hand, a blisk (rotor) also rotates in grinding a tip of a rotor blade in the blisk. However, the rotation speed of a blisk is suppressed, to some extent, to be less than the rotation speed of a blade-disk assembled wheel during grinding. This is because if the rotation speed of a blisk is excessively increased, then in grinding a tip, the tip might vibrate and a stress leading to damage to the rotor blade might be applied to a blade root.

Therefore, in a case where axial-flow turbomachinery formed by combining a blade-disk assembled wheel with a blisk is used, in the manufacturing process of the axial-flow turbomachinery a grinding work of a blade-disk assembled wheel performed while a rotor is rotated rapidly and a grinding work of a blisk performed while a rotor is rotated at a low speed need to be performed in separate stages. Such grinding works in separate stages cause a decrease in working efficiency.

The present disclosure has been made in view of the above-described circumstances. The object of this disclosure is to provide a method for grinding a tip of a rotor blade, the method being capable of concurrently performing, under a rapid rotation of a rotor, a grinding work of a tip of a rotor blade in a blisk formed from an integrated disk and blade and a grinding work of a tip of a rotor blade in a blade wheel (blade-disk assembled wheel) formed from a separate disk and blade, and a blade-tip grinding jig used in performing this method.

A first aspect of this disclosure is a method for grinding a tip of a blade, including: a movement restriction step of restricting a relative movement of a blade with respect to a disk of the blade of a blisk by a jig inserted between a blade cascade of the blisk in a rotor and a blade cascade adjacent to the blade cascade of the blisk, the blisk being formed from the disk and the blade both integrally provided; and a grinding step of concurrently grinding a tip of the blade of the blisk in the rotor and a tip of a blade of a blade wheel during rotation of the rotor at a predetermined speed, the blade wheel being formed from a disk and a blade both separately provided.

The movement restriction step may include inserting the jig into each space between the blade cascade of the blisk and blade cascades on both sides of the blade cascade of the blisk. The grinding step may include concurrently grinding the tip of the blade of the blisk whose relative movement is restricted by the jig and the tip of the blade of the blade wheel.

A second aspect of this disclosure is a jig for grinding a tip of a blisk, configured to be inserted between a blade cascade of the blisk formed with a disk and blades both integrally provided and a blade cascade adjacent to the blade cascade of the blisk in grinding the tip of the blade in the blisk, the blades of the blisk being present in a rotor with blades of a blade wheel formed from a disk and blades both separately provided. The jig includes: a disk locking section configured to be locked to the disk of the blade of the blisk while being inserted between the blade cascades; a blade locking section configured to be locked to an airfoil of the blisk including the disk to which the disk locking section is locked, while being inserted between the blade cascades; and a connecting section configured to connect the disk locking section and the blade locking section.

According to this disclosure, a grinding work of a tip of a rotor blade including a blisk formed from an integrated disk and rotor blade and a grinding work of a tip of a rotor blade including a blade wheel formed from a separate disk and blade can be concurrently performed under rapid rotation of a rotor.

DESCRIPTION OF THE EMBODIMENTS

Figure 1:
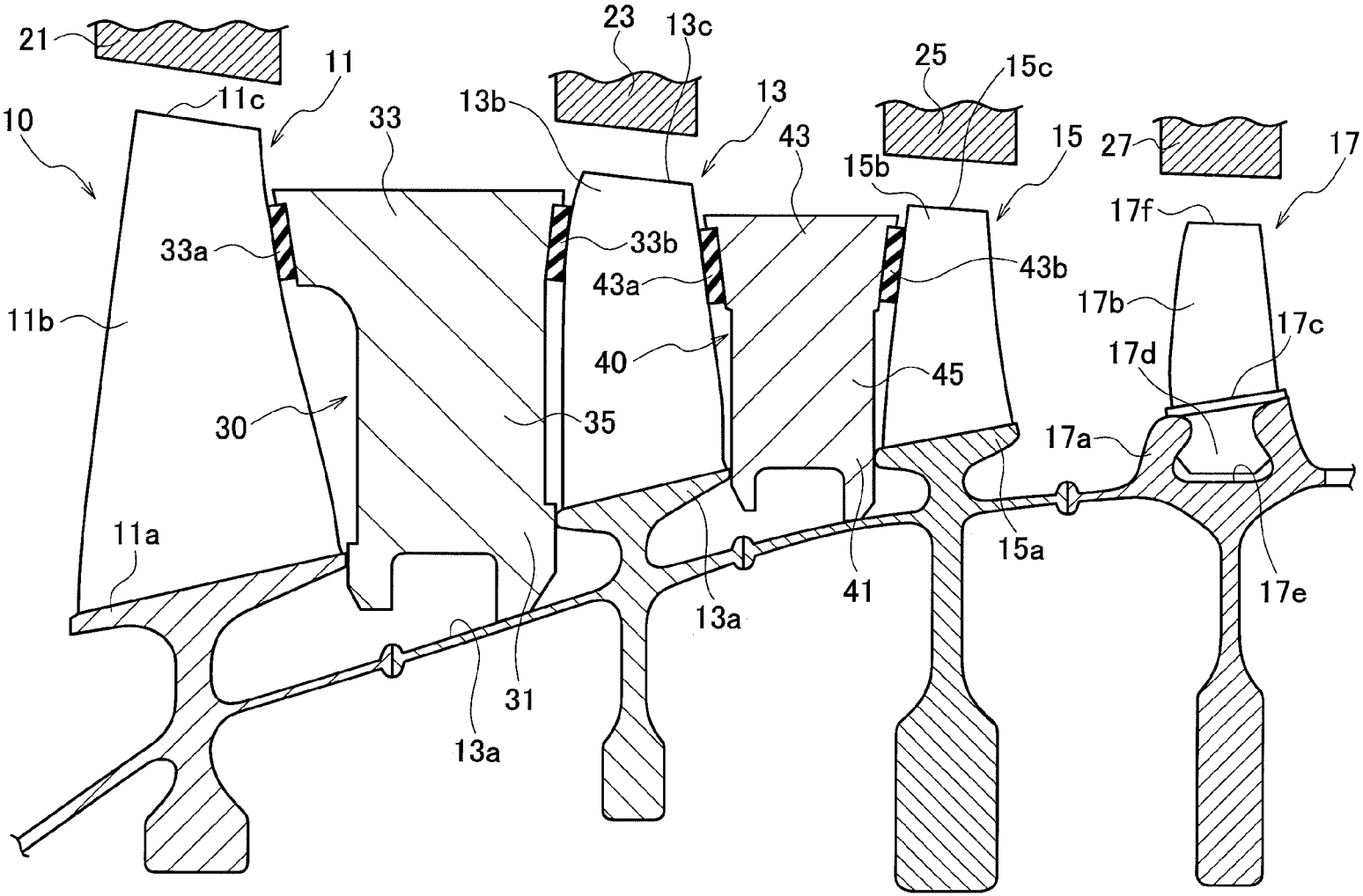
FIG. 1 is a cross sectional view illustrating a main portion of a rotor, where a grinding work of a tip is performed using a jig, according to an embodiment of this disclosure.

Hereinafter, the embodiments of this disclosure will be described with reference to the accompanying drawings. FIG. 1 is across sectional view illustrating a main portion of a rotor, where a grinding work of a blade tip is performed using a jig according to an embodiment of this disclosure.

A rotor 10 illustrated in FIG. 1 is used for axial-flow turbomachinery, such as a compressor or a turbine. The rotor 10 includes a plurality of blade cascades 11, 13, 15, 17 mounted on a rotary shaft (not illustrated). The blade cascades 11, 13, 15 are located on an intake side of compression fluid (not illustrated). The blade cascade (rotor blade) 11 includes a plurality of rotor blades (blades) 11*b*, and the plurality of rotor blades 11*b* are integrated with a disk 11*a*. That is, the plurality of rotor blades 11*b* and the disk 11*a* constitute a single blisk. Similarly, a plurality of rotor blades (blades) 13*b* constituting a blade cascade (rotor blade) 13 and a disk 13*a* constitute a single blisk, and a plurality of rotor blades (blades) 15*b* constituting a blade cascade (rotor blade) 15 and a disk 15*a* constitute a single blisk. Moreover, a blade cascade 17 is located on a discharge port side of compression fluid from the blade cascades 11, 13, 15.

A plurality of rotor blades (blades) 17*b* constituting the blade cascade (rotor blade) 17 are separately provided from a disk 17*a*, and are fitted into the disk 17*a*. The rotor blade 17*b* is detachable from the disk 17*a*. That is, the plurality of rotor blades 17*b* and the disk 17*a* constitute a blade wheel, in which the plurality of rotor blades 17*b* are separated from the disk 17*a*, (referred to as a blade-disk assembled wheel, for convenience of description). The rotor blade 17*b* has a dovetail 17*d* in a platform 17*c* thereof, and the dovetail 17*d* extends in a direction away from a blade body of the rotor blade 17*b*. The rotor blade 17*b* is coupled with the disk 17*a* by fitting the dovetail 17*d* into a slot 17*e* formed in the circumferential surface of the disk 17*a*.

As the rotor 10 rotates, the position of each rotor blade 17 in the blade cascade 17 will vary in the radial direction of the rotor 10, within a range of a clearance between the dovetail 17*d* and the slot 17*e*. This is because a centrifugal force acts on the rotor blade 17*b* due to the rotation of the rotor 10. The faster the rotation speed of the rotor 10, the further the position of the rotor blade 17*b* moves outward in the radial direction from the rotation center axis of the rotor 10.

Incidentally, in the above-described rotor 10, it is important to precisely finish the blade length of each of the rotor blades 11*b*, 13*b*, 15*b*, 17*b* in order to maintain the airtightness of a combustion gas between the rotor blades. Then, in manufacturing the rotor 10, a work for grinding (polishing) the blade tip (tip) (11*c*, 13*c*, 15*c*, 17*f*) of the rotor blade (1*b*, 13*b*, 15*b*, 17*b*) with a grindstone (21, 23, 25, 27) while rotating the blade cascade (11, 13, 15, 17) is performed.

With regard to the grinding of the rotor blade 17*b* of the blade cascade 17, the tip 17*f* has to be ground (polished) so that the tip 17*f* reaches an appropriate position during actual operation of a compressor or a turbine, taking into consideration the movement of the rotor blade 17*b* in the radial direction of the rotor 10 due to the rotation of the rotor 10. In order to do so, the rotor 10 needs to be rotated at a predetermined speed to give a sufficient centrifugal force to the rotor blade 17*b*, so that the position of the rotor blade 17*b* in the radial direction of the rotor 10 is located at a position similar to the position during actual operation.

On the other hand, regarding grinding of the rotor blade (11*b*, 13*b*, 15*b*) of the blade cascade (11, 13, 15), when the rotor 10 rotates at the rotation speed in grinding the rotor blade 17*b*, the tip (11*c*, 13*c*, 15*c*) side of the rotor blade (11*b*, 13*b*, 15*b*) may significantly vibrate due to an impact during grinding with the grindstone (21, 23, 25). If this vibration occurs on the tip (11*c*, 13*c*, 15*c*) side of the rotor blade (11*b*, 13*b*, 15*b*), a stress leading to an damage to the rotor blade (11*b*, 13*b*, 15*b*) may be applied to a blade root on the disk (11*a*, 13*a*, 15*a*) side.

Then, in the rotor 10 of this embodiment, the grinding of the blade cascade (11, 13, 15) of a blisk and the grinding of the blade cascade 17 of the blade-disk assembled wheel are concurrently performed. That is, the grinding of the tip (11*c*, 13*c*, 15*c*) of the rotor blade (11*b*, 13*b*, 15*b*) and the grinding of the tip 17*f* of the rotor blade 17*b* are concurrently performed in accordance with a movement restriction step (step S1) and a grinding step (step S3) illustrated in a flow chart of FIG. 2. Hereinafter, each step will be described.

The movement restriction step (step S1) is the step performed before grinding the tip (11*c*, 13*c*, 15*c*, 17*f*) with the grindstone (21, 23, 25, 27) with rapid rotation of the rotor 10 at a predetermined speed. As illustrated in FIG. 1, in a state where the rotation of the rotor 10 stops, the relative movement of the rotor blade (11*b*, 13*b*, 15*b*) with respect to the disk (11*a*, 13*a*, 15*a*) is restricted with the jig (30, 40).

The jig (30, 40) is inserted between the blade cascades (11, 13, 15). In this embodiment, the jig 30 is inserted between the blade cascade 11 and the blade cascades 13, i.e., between the rotor blade 11*b* of the blade cascade 11 and the rotor blade 13*b* of the blade cascade 13. Moreover, the jig 40 is inserted between the blade cascade 13 and the blade cascades 15, i.e., between the rotor blade 13*b* of the blade cascade 13 and the rotor blade 15*b* of the blade cascade 15.

The jig 30 includes a disk locking section 31, a blade locking section 33, and a connecting section 35 to connect the disk locking section 31 and blade locking section 33. The jig 30 is inserted between the rotor blade 11*b* of the blade cascade 11 and the rotor blade 13*b* of the blade cascade 13 from the disk locking section 31 side. As the result of this insertion, the disk locking section 31 is abutted against and locked to the disk (11*a*, 13*a*) of each blade cascade (11, 13). That is, the disk locking section 31 is sandwiched in the axial direction of the rotor 10 by the disk 11*a* and the disk 13*a*.

Because the disk locking section 31 is sandwiched by the disk 11*a* and the disk 13*a*, the disk locking section 31 is pressed in the axial direction of the rotor 10 from the disk 11*a* and the disk 13*a*. As the result, a frictional force acts between the disk locking section 31 and the disk 11*a* and between the disk locking section 31 and the disk 13*a*, and the relative movement (e.g., the movement along the circumferential direction of the rotor 10) of the jig 30 with respect to the disk (11*a*, 13*a*) is restricted. That is, the disk locking section 31 of this embodiment has a width sufficient for restricting such relative movement in the axial direction of the rotor 10.

Moreover, the disk locking section 31 is abutted, in the radial direction of the rotor 10, against either of the disk 11*a* or the disk 13*a*. With this abutting, the relative position of the jig 30 with respect to the rotary shaft of the rotor 10 is restricted. Accordingly, for example, the jig 30 can be distributed on an identical circle with respect to the rotary shaft of the rotor 10, which contributes to the fast and stable rotation of the rotor 10.

The blade locking section 33 is abutted against and locked to one (e.g., trailing edge) of the side sections in the width direction (the chord direction) of the rotor blade 11*b* of the blade cascade 11 via a damping member 33*a* made from rubber or the like. Similarly, the blade locking section 33 is abutted against and locked to one (e.g., leading edge) of the side sections in the width direction (the chord direction) of the rotor blade 13*b* of the blade cascade 13 via a damping member 33*b* made from rubber or the like. That is, the blade locking section 33 is sandwiched in the axial direction of the rotor 10 by the rotor blade 11*b* and rotor blade 13*b*.

Because the blade locking section 33 is sandwiched by the rotor blade 11*b* and rotor blade 13*b*, the blade locking section 33 is pressed in the axial direction of the rotor 10 from the rotor blade 11*b* and the rotor blade 13*b*. As the result, a frictional force acts between the blade locking section 33 and the rotor blade 11*b* and also between the blade locking section 33 and the rotor blade 13*b*, and the relative movement (e.g., the movement along the circumferential direction of the rotor 10) of the jig 30 with respect to the rotor blade (11*b*, 13*d*) is restricted. That is, the blade locking section 33 of this embodiment has a width sufficient for restricting such relative movement in the axial direction of the rotor 10.

The jig 30 inserted between the blade cascades 11, 13 fixes the position of the rotor blade (11*b*, 13*b*), which locks the blade locking section 33 via the damping member (33*a*, 33*b*), with respect to the position of the disk (11*a*, 13*a*) locking the disk locking section 31. Thus, the relative movement of the rotor blade (11*b*, 13*b*) of the blade cascade (11, 13) with respect to the disk (11*a*, 13*a*) is restricted by the jig 30.

The jig 40 has a structure similar to that of the jig 30. That is, the difference between the jig 30 and the jig 40 is that while the jig 30 has a cross-sectional shape corresponding to the rotor blade (11*b*, 13*b*) and disk (11*a*, 13*a*), the jig 40 has a cross-sectional shape corresponding to the rotor blade (13*b*, 15*b*) and disk (13*a*, 15*a*). Accordingly, the action of the jig 40 itself is identical to the action of the jig 30 itself. The jig 40 includes a disk locking section 41, a blade locking section 43, and a connecting section 45 for connecting the disk locking section 41 and the blade locking section 43. The jig 40 is inserted between the rotor blade 13*b* of the blade cascade 13 and the rotor blade 15*b* of the blade cascade 15 from the disk locking section 41 side. As the result of this insertion, the disk locking section 41 is abutted against and locked to the disk (13*a*, 15*a*) of each blade cascade (13, 15). That is, the disk locking section 41 is sandwiched in the axial direction of the rotor 10 by the disk 13*a* and the disk 15*a*. Moreover, the blade locking section 43 is abutted against and locked to one (e.g., trailing edge) of the side sections in the width direction (the chord direction) of the rotor blade (13*b*, 15*b*) of the blade cascade (13, 15) via a damping member 43*a* made from rubber or the like. Similarly, the blade locking section 43 is abutted against and locked to one (e.g., leading edge) of the side sections in the width direction (the chord direction) of the rotor blade 15*b* of the blade cascade 15 via a damping member 43*b* made from rubber or the like.

The jig 40 inserted between the blade cascades 13, 15 fixes the position of the rotor blade (13*b*, 15*b*) which locks the blade locking section 43 via the damping member (43*a*, 43*b*), relative to the position of the disk (13*a*, 15*a*) locking the disk locking section 41. Thus, the relative movement of the rotor blade (13*b*, 15*b*) of the blade cascade (13, 15) with respect to the disk (13*a*, 15*a*) is restricted by the jig 40.

Figure 3:
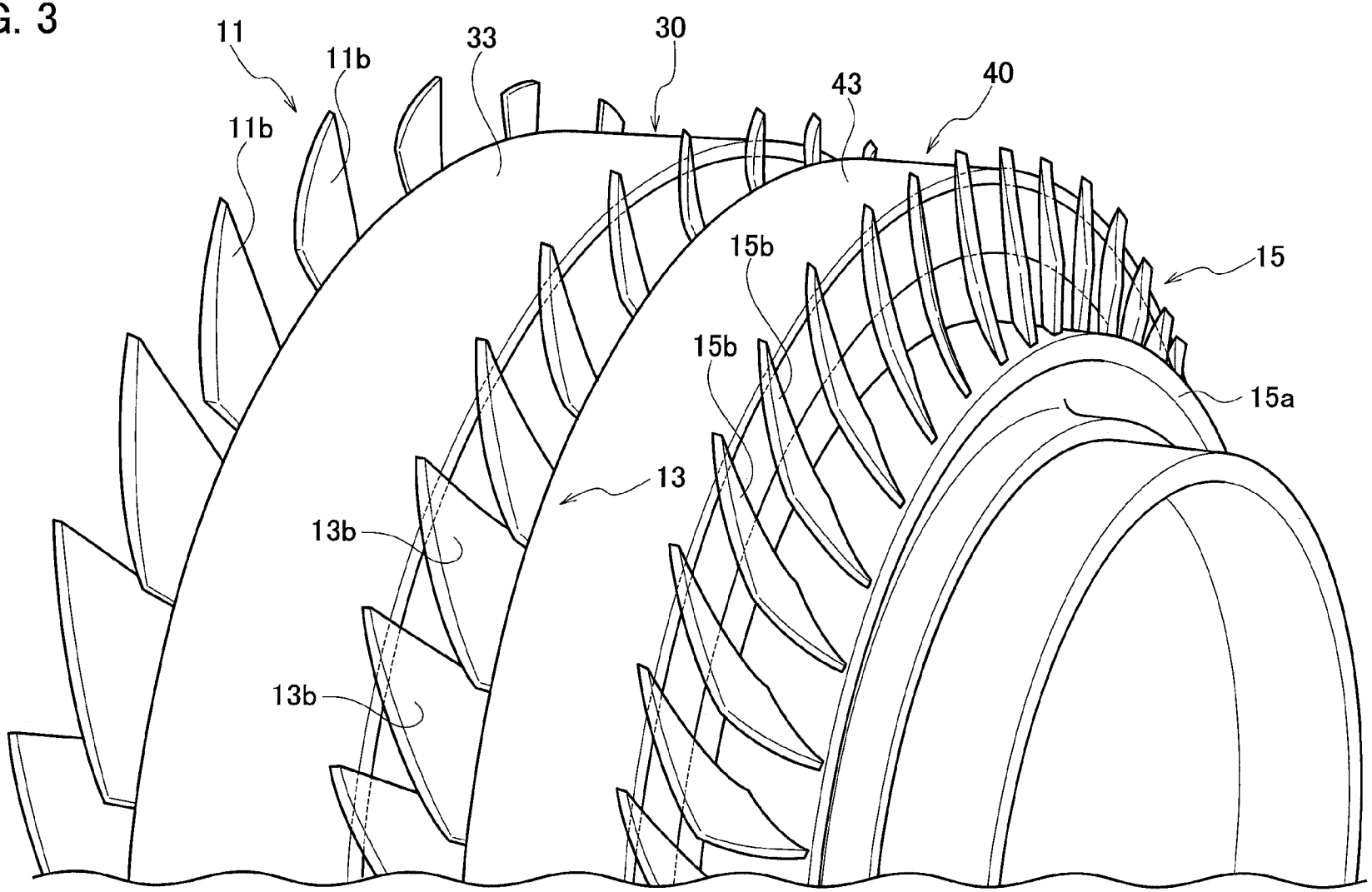
FIG. 3 is a perspective view illustrating an enlarged portion of the rotor of FIG. 1.

Note that, although FIG. 3 illustrates the jig (30, 40) just partially, the jig (30, 40) may be inserted, across the entire-circumference in the rotation direction of the rotor 10, between the rotor blades 11*b* (13*b*) of the blade cascade 11 (13) or between the rotor blades 13*b* (15*b*) of the blade cascade 13 (15). That is, the jig 30 (40) may be one of a plurality of segments forming a ring which extends in the circumferential direction of the rotor 10. In that case, the jig 30 (40) can be constructed so as to be able to expand in the shape of a strip or to be divided into a plurality of arc-shaped parts by detaching the coupling of the coupling section due to a coupler (not illustrated).

In performing a grinding work of the blade cascade (11, 13, 15) using the above-described jig (30, 40), the grinding is carried out while the relative displacement of the rotor blade (11*b*, 13*b*, 15*b*) with respect to the disk (11*a*, 13*a*, 15*a*) is restricted. Accordingly, the vibration of the rotor blade (11*b*, 13*b*, 15*b*) due to an impact during grinding is suppressed. That is, rotating the blisk at the rotation speed of that in grinding the rotor blade 17*b* of the blade-disk assembled wheel, enables the rotor blade (11*b*, 13*b*, 15*b*) to be ground.

Figure 2:
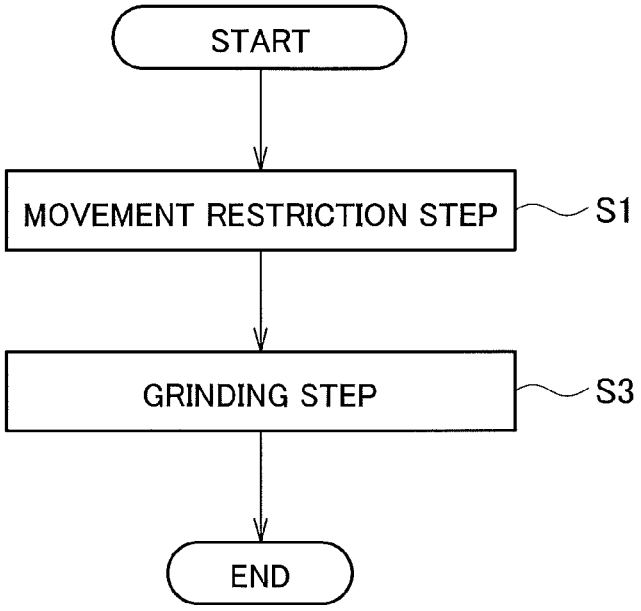
FIG. 2 is a flow chart illustrating the steps in a method for grinding a tip of a rotor blade, according to an embodiment of this disclosure.

Then, the grinding step of step S3 illustrated in FIG. 2 is performed after the movement restriction step of step S1. In this grinding step, the rotor 10 illustrated in FIG. 1 is rapidly rotated at a predetermined speed suitable for grinding the tip 17*f* of the blade cascade 17 of the blade-disk assembled wheel. Then, the tip (11*c*, 13*c*, 15*c*) of the blade cascade (11, 13, 15) of the blisk and the tip 17*f* of the blade cascade 17 of the blade-disk assembled wheel are concurrently ground using the grindstone (21, 23, 25, 27).

At this time, the relative movement of the rotor blade (11*b*, 13*b*, 15*b*) of the blade cascade (11, 13, 15) with respect to the disk (11*a*, 13*a*, 15*a*) is restricted by the jig (30, 40) inserted between the rotor blades 11*b*, 13*b* or between the rotor blades 13*b*, 15*b*. Accordingly, even if the tip (11*c*, 13*c*, 15*c*) of the blade cascade (11, 13, 15) is ground with rapid rotation of the rotor 10 at a predetermined speed, the application of a stress onto the blade root side of the rotor blade (11*b*, 13*b*, 15*b*), the stress leading to an damage to the rotor blade (11*b*, 13*b*, 15*b*), can be suppressed.

Therefore, by executing the movement restriction step of the step S1 in FIG. 2 and the grinding step of step S3, the grinding work of the tip (11*c*, 13*c*, 15*c*) of the blade cascade (11, 13, 15) of the blisk and the grinding work of the tip 17*f* of the blade cascade 17 of the blade-disk assembled wheel can be concurrently performed with rapid rotation of the rotor 10 at a predetermined speed suitable for grinding the tip 17*f* of the blade cascade 17.

Note that, in this embodiment, in the movement restriction step, a jig is not inserted between the rotor blades 15*b* of the blade cascade 15 and a jig is not inserted also between the rotor blades 17*b* of the blade cascade 17. However, the grinding work of the tip (11*c*, 13*c*, 15*c*, 17*f*) of the blade cascade (11, 13, 15, 17) in the grinding step may be performed with a jig inserted between the rotor blades 15*b* and between the rotor blades 17*b*.

As described above, in grinding the tip of the rotor blade of the blade-disk assembled wheel, the rotor has to be rotated at such a predetermined rotation speed that the tip of the relevant rotor blade is arranged at a position, in the radial direction of the rotor, similar to a position during actual operation. The predetermined speed herein is a speed at which a centrifugal force sufficient for the tip of the rotor blade of the blade-disk assembled wheel to be arranged at a position in the radial direction of the rotor similar to a position during actual operation is applied to the relevant rotor blade.

If the tip of the rotor blade of the blisk is ground with rotation of the rotor at such a predetermined rotation speed, the tip may vibrate due to an impact during grinding and a stress leading to damage to the rotor blade may be applied to the blade root.

However, according to the grinding method of this embodiment, a jig is inserted between the blade cascades of a blisk. In this case, the jig is locked by the rotor blades and disks on both sides thereof, and the relative movement of the rotor blade with respect to the disk is restricted. Accordingly, even if the tips of the rotor blades on both sides of the jig are ground, the vibration of the tip due to an impact during grinding is suppressed. Therefore, when the grinding work of the tip of the rotor blade of a blade-disk assembled wheel is performed with rapid rotation of the rotor at a predetermined rotation speed, the grinding work of the tip of the rotor blade of the blisk can be concurrently performed.

Note that, a jig is preferably inserted, across the entire-circumference in the rotation direction of a rotor, between a blade cascade of a blisk and a blade cascade adjacent thereto.

Moreover, when a jig is inserted between one blade cascade of a blisk and blade cascades on both adjacent sides thereof, respectively, the relative movement of a rotor blade located between the jigs with respect to a disk is restricted from the both sides thereof. Therefore, the relative movement of the tip of a rotor blade with respect to the disk of the blisk can be reliably suppressed with the jigs on both sides of the rotor blade. Accordingly, grinding of the tip of a rotor blade of a blisk can be performed while more firmly protecting the blade root of the rotor blade.

According to the jig of this embodiment, while being inserted between a blade cascade of a blisk and the blade cascade adjacent thereto, a disk locking section is locked to a disk of the blade cascade and a blade locking section is locked to the blade of the same rotor blade as the disk to which the disk locking section is locked. Moreover, the disk locking section and the blade locking section are connected via a connecting section. Accordingly, the relative movement of a blade with respect to the disk of a rotor blade is restricted.

Therefore, even if a tip of a rotor blade of a blisk is ground with rapid rotation of a rotor, vibration of the tip due to an impact during grinding can be suppressed. Accordingly, when a grinding work of the tip of a rotor blade of a blade-disk assembled wheel is performed with rapid rotation of a rotor, a grinding work of the tip of a rotor blade of a blisk can be concurrently performed.

What is claimed is:

1. A method for grinding tips of blades, comprising:

a movement restriction step of inserting a first jig between a first blade cascade of a blisk in a rotor and a second blade cascade axially adjacent to the first blade cascade of the blisk until the first jig is sandwiched by the first and second blade cascades, the blisk including a first disk and first blades as the first blade cascade both integrally provided; and a grinding step of concurrently grinding tips of the first blades of the blisk and tips of the second blades of a wheel in the rotor during rotation of the rotor at a predetermined speed, the wheel being rotated together with the blisk and including a second disk and the second blades detachably fitted to the second disk.

2. The method according to claim 1, wherein the movement restriction step includes inserting a second jig between the first blade cascade of the blisk and a third blade cascade axially adjacent to the first blade cascade until the second jig is sandwiched by the first and third blade cascades, the third blade cascade located on an opposite side of the first blade cascade from the second blade cascade.

3. A jig for a blisk, configured to be inserted between a first blade cascade of the blisk including a first disk and first blades as the first blade cascade both integrally provided and a second blade cascade axially adjacent to the first blade cascade of the blisk in polishing tips of the first blades of the blisk, the blisk being present in a rotor with a wheel including a second disk and second blades detachably fitted to the second disk, the jig comprising:

a disk locking section configured to be locked to the first disk of the blisk while the jig is inserted and sandwiched between the first and second blade cascades;

a blade locking section configured to be locked to the first blades of the blisk, while the jig is inserted and sandwiched between the first and second blade cascades; and a connecting section configured to connect the disk locking section and the blade locking section.

4. The jig according to claim 3, further comprising a first damping member disposed between the blade locking portion and the first blade cascade.

5. The jig according to claim 4, further comprising a second damping member disposed between the blade locking portion and the second blade cascade.

6. The jig according to claim 3, wherein the disk locking section configured to be further locked to a third disk of the second blade cascade.

7. The jig according to claim 3, wherein the blade locking section configured to be further locked to third blades of the second blade cascade.

* * * * *